United States Patent [19]

Headen

[11] Patent Number: 4,603,606

[45] Date of Patent: Aug. 5, 1986

[54] UNIDIRECTIONAL DRIVE TOOL CARTRIDGE AND METHOD OF MANUFACTURE

[75] Inventor: James Headen, Lewisville, Tex.

[73] Assignee: Radian Tool Corporation, Lewisville, Tex.

[21] Appl. No.: 629,083

[22] Filed: Jul. 9, 1984

[51] Int. Cl.[4] ..... B25B 13/46

[52] U.S. Cl. ..... 81/59.1

[58] Field of Search ..... 81/60–63.2, 81/59.1, 439

[56] References Cited

U.S. PATENT DOCUMENTS

| | | | |
|---|---|---|---|
| 1,609,086 | 11/1926 | Hurschman | 81/59.1 |
| 3,534,836 | 10/1970 | Dane | 81/63.1 X |
| 3,590,667 | 7/1971 | Berglein | 81/59.1 |
| 4,051,935 | 10/1977 | Nakayama | 81/59.1 X |
| 4,408,504 | 10/1983 | Dobosh | 81/59.1 |

*Primary Examiner*—Frederick R. Schmidt
*Assistant Examiner*—Debra S. Meislin
*Attorney, Agent, or Firm*—Thomas L. Cantrell; Stanley R. Moore

[57] ABSTRACT

A unidirectional drive tool cartridge for use as a torque transmitting device which includes a housing within which is mounted a unidirectional continuous clutch and drive shaft assembly. The drive shaft is carried within a bearing member located within a clutch. The bearing member has a central opening configured to receive a shoulder portion of the drive shaft so that the drive shaft may be slidably moved along an axis of its rotation within the bearing element and may be rotatably drive by the bearing element around the axis of rotation. Front and back faces of the housing are provided to constrain the longitudinal movement of the drive shaft therein. By virtue of the operation of the unidirectional clutch, the drive shaft may be driven in one direction on rotation of the head and is not driven in an opposite rotation of the head. The drive shaft is selectively movable within the housing to extend from either rotational direction, depending upon the direction of extension of the drive shaft therefrom. In this manner the unidirectional drive cartridge may be secured to a myriad of conventional torque application members such as wrenches or the like and/or in replacement of worn or broken ratchet assemblies.

3 Claims, 9 Drawing Figures

UNIDIRECTIONAL DRIVE TOOL CARTRIDGE AND METHOD OF MANUFACTURE

BACKGROUND OF INVENTION

1. Field of the Invention

The present invention relates to torque transmission devices and, more particularly, to a one-way, continuous drive tool cartridge and method of manufacturing.

2. Description of the Prior Art

The prior art is replete with one-way, or unidirectional, torque transmission devices such as socket wrenches and the like. Early mechanism designs affording relative rotation in a single direction generally incorporated "step-acting" ratchet wheel configurations. Later developments implemented "stepless-acting" embodiments wherein a central rotating body moved relative to an outside head. With such devices, the rotation of a central body is usually controlled either by the ratchet wheel or a one-way clutch arrangement. One such clutch arrangement of contemporary design includes a series of roller bearings housed within wedge-shaped cavities in the outside head. When rotation of the central body is attempted in a first direction, the bearings are permitted to move in the direction of an enlarged portion of the wedge-shaped openings, allowing rotation. When rotation is attempted in an opposite direction, the roller bearings are forced into narrower or constricted portions of the wedge cavities, thereby constraining rotation. Such universal, stepless-acting wrenches are common and one particular embodiment is shown in U.S. Pat. No. 3,590,667 to Berglein.

Subsequent prior art developments in unidirectional drive torque transmission systems have addressed refinements in the stepless-acting wrench. One particular area of improvement lies in the reduction of backlash in the drive actuation as well as the reduction of friction. Previously known ratchet wrenches had the disadvantage that they could only act in direct steps. This was a marked disadvantage for many conventional wrench applications. However, the wrench designs capable of stepless-acting actuation would often not facilitate the high torque forces necessary for certain loading configurations.

For the above reasons, great emphasis was placed upon the design of a one-way, torque clutch configuration for facilitating large rotational loads. One such torque-applying handtool is set forth as shown in U.S. Pat. No. 4,051,935 issued to Nakayama. The stepless mechanism of this patent comprises a polygonal shaft and series of rollers, each being placed in touch with each side of the polygon shaft. Each roller is selectively forced to one end or the other of each side so that the polygon shaft maybe turned in one direction when the tool handle is turned. Likewise, U.S. Pat. No. 3,534,836 issued to Dane illustrates a ratcheting mechanism comprising a number of paired sprag members pivotally mounted in spaced notches on a socket member rotatably mounted within a housing. One sprag of each pair will permit rotation of the housing relative to the socket member in the direction of the pivoted sprag, but will jam if the housing is rotated in the other direction. In this manner a ratcheting action is provided which is smoother and has no backlash in its 360° rotation.

The aforesaid tool drive configurations are marked improvements over spring and pawl arrangements of early one-way drive systems. Such devices, as described above, utilized a spring biased pawl which generally engaged the teeth of a driven gear. The pawl was arranged so as to be cammed away from the gear teeth upon rotation of the gear in one direction but forced into engagement with the gear teeth to perform a wedging action that immobilized the gear when the gear was turned in the other direction. While effective in torque transmission, this type of ratchet necessarily included considerable drag between the pawl and gear as well as backward or opposite rotation known as backlash.

The technology of the above described patents have provided a numerous advantages for industry and the convenience of unidirectional torque drive systems have become widely accepted in various industries. For this reason, more recent developments have addressed further improved torque transmission tools. For example, co-pending patent application Ser. No. 479,843 filed 3/28/83 now abandoned sets forth and describes a unidirectional, stepless, clutch driven tool having numerous advantages over the prior art. As described therein, a torque transmitting drive shaft is provided with front and back socket drive elements on either side of a central shouldered portion. Means are provided for receiving the drive shaft within a central core to enable the drive shaft to be selectively, longitudinally positioned along the axis of rotation within the core to extend from a front or back face as needed. In this manner, when the drive shaft is longitudinally located to extend from a first face, a torque applied to the head is transmitted only in one direction by the drive shaft. When the drive shaft is longitudinally located in the opposite direction, extending from of the opposite face, a torque applied to the head, in an opposite direction is then transmitted only in that direction. This is accomplished with a single, one-way clutch.

It may thus be seen that improvements upon prior art clutch drive and bearing assemblies, unidirectional, stepless transmission systems and the like have focussed upon integral wrench assemblies including a driving head assembly and handle. The torque transmission tools described above each include such an assembly and, while effective in torque transmission, are limited by the availability of the wrench housing and handle assembly. In the event of damage to the clutch mechanism the wrench is generally of no further use.

It would be an advantage therefore, to provide a tool system having a unidirectional torque transmission device not integrally formed within the wrench housing. In this manner a damaged drive mechanism may be replaced in an economical fashion and assembly of the tool itself maybe facilitated by eliminating unnecessary assembly forces upon the generally delicate drive mechanism. The present invention provides such an improvement over the prior art by providing a unidirectional drive cartridge integrally housed within an assembly which may be mounted in a plurality of handle and wrench configurations. In this manner the cartridge may be utilized in a myriad of applications not heretofore possible. With a longitudinally positionable drive shaft extending from the cartridge the reliability and feasibility of non-integrated assemblies becomes a reality in accordance with the principles of the present invention.

SUMMARY OF THE INVENTION

The present invention pertains to a unidirectional drive tool cartridge for improved torque application systems. More particularly, the present invention relates to a unidirectional drive cartridge adapted for securement to a force application member for directional torque transmission. The cartridge comprises a housing and a unidirectional clutch mounted within the housing, the clutch having a central opening extending therethrough. A torque transmitting drive shafts disposed within the clutch and includes front and back portions for extending outwardly of the clutch and a central shoulder portion for containment therein. Means are provided for receiving the drive shaft with the end of the central opening of the clutch to enable selective longitudinal positioning of the drive shaft within the receiving means and rotational engagement of the drive shaft by the receiving means. The drive shaft receiving means is further located within the clutch to freely rotate in a first direction and to be constrained by the clutch against rotation in a second opposite direction. The housing further included front and back faces, each having a central aperture within which the front and back drive shaft portions are located and of a size to engage the shoulder portion of the drive shaft against the faces to constrain it within the receiving means. The drive shaft is also longitudinally located within the housing wherein a torque applied to the housing will be transmitted only in one direction by the drive shaft. When the drive shaft is longitudinally located in the direction of an opposite face, a torque applied to the housing will be transmitted only in an opposite direction.

In another embodiment, the drive shaft of the aforesaid cartridge is of a generally square cross-sectional configuration. The drive shaft is also adapted to receive a socket mounted thereon in secured engagement therewith for the transmission of torque therethrough. In providing for this function, the drive shaft further comprises socket retainer elements on the front and back portions thereof. The clutch may be a Torrington type clutch for providing unidirectional torque application. The cartridge housing may also comprise first and second thin wall cups adapted for matingly engaging the clutch for securing the drive shaft therein. In another embodiment of the invention, the housing comprises a generally cylindrical tubular member having a first face formed on the first end thereof with an aperture formed therethrough for receiving the drive shaft therein and means disposed in a second opposite end of the housing for securing the drive shaft and the clutch therein.

In yet another embodiment, the invention includes one-way drive tool cartridge for utilization with torque transmission members comprising a housing and a unidirectional continuous drive clutch mounted within the housing. A socket drive element is also disposed within the clutch to be rotatably driven by the clutch only in one direction. The socket drive element is transversely movable along an axis of rotation which may be selectively located along the axis to extend from either a front or back face of the housing. The housing comprises at least one thin wall cup member for containing the clutch and socket drive element therein.

In yet a further embodiment, the invention includes a method of manufacturing a unidirectional drive tool comprising the steps of providing a housing and providing a unidirectional clutch adapted for mounting within the housing. A drive shaft is provided and adapted for mounting within the unidirectional clutch. Means are provided for receiving the drive shaft within the clutch for selective longitudinal positioning therewithin and rotational engagement thereof for selective torque transmission. A torque application tool is provided having a region formed therein for securement of the housing. The housing is then secured within the region of the tool for selective unidirectional torque drive application.

BRIEF DESCRIPTION OF THE DRAWINGS

For a more complete understanding of the present invention, and for further objects and advantages thereof, reference may now be had to the following description taken in conjunction with the accompanying drawings, in which.

DETAILED DESCRIPTION OF THE PREFERRED EMBODIMENT

Figure 1:
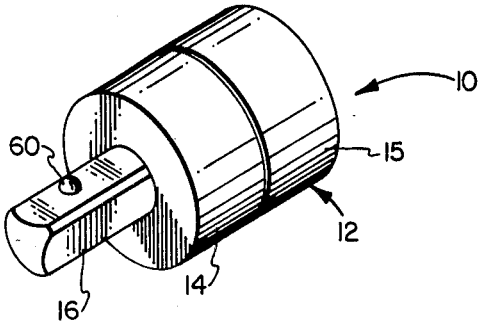
FIG. 1 is a perspective view of a unidirectional drive tool cartridge constructed in accordance with the principles of the present invention.

Referring first to FIG. 1 there is shown a perspective view of a unidirectional drive tool cartridge constructed in accordance with the principles of the present invention. A tool cartridge 10 is illustrated comprising a cartridge housing 12 including a first cup 14 and second cup 15. Within the housing 12 a drive shaft 16 is mounted for longitudinal positioning therein. A roller clutch (not shown) is provided within the housing 12 and around a core 20 for purposes of a unidirectional torque transmission, as described in more detail below.

Figure 2:
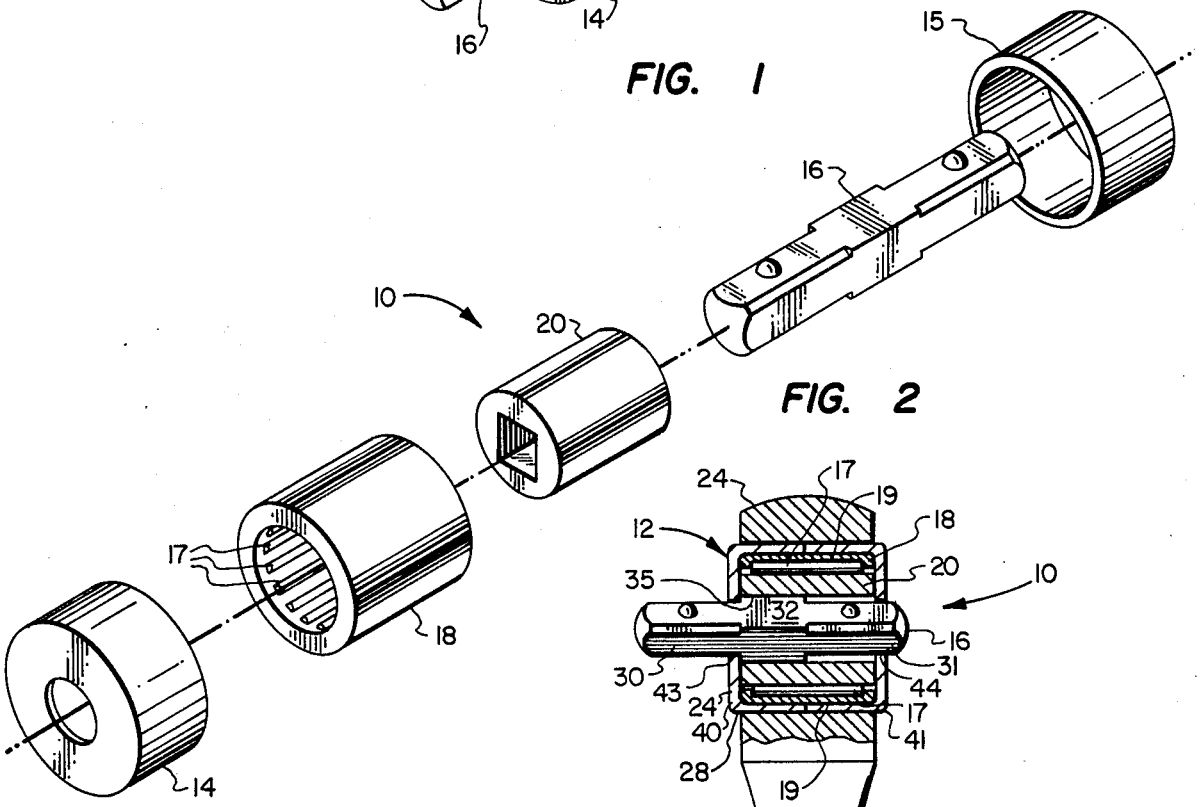
FIG. 2 is an exploded, perspective view of the tool cartridge of FIG. 1 illustrating one embodiment of the assembly thereof.

Referring now to FIG. 2, there is shown an exploded view of the tool cartridge 10 of FIG. 1. The cartridge 10 is shown to be constructed with an inner clutch 18 constructed for one-way rotation. The clutch 18 is mounted into the cups 14 and 15 and affixed therein by press fitting, or other appropriate fastening means (not shown). The clutch 18 can conveniently be of any roller or needle bearing type of continuous or stepless action as described above. For example, such bearings as clutch 20 may conveniently be of the type sold by the Torrington Company of type RC. Such drawn cup roller clutches are fabricated in a way to allow an internally located bearing member 17 to turn or rotate in one direction, but to engage ramp or wedge 19 (shown in FIG. 3) constrain the internally contained bearing member from rotation in an opposite direction. The clutch includes ramps 19 and needle bearings 17 of highly controlled tolerances to produce an action which is essentially stepless or continuous. Thus, as will be apparent, in operation in the environment of a wrench presently to be described, the roller or needle bearing 17 provides an almost instantaneous catching by the wedge 19 when rotated in the direction of torque transmission to the drive elements. Likewise, an instantaneous release is provided when the cartridge 10 is rotated in an opposite direction. Conventional wrench designs, as set forth below, may be adapted to accommodate the tool cartridge 10 and thus, exhibit the unidirectional drive aspects described in accordance with the present invention.

Still referring to FIG. 2, the core 20 is provided for being received within the clutch bearing 18 and for receiving the drive shaft 16 therein. The core 20 is preferably of a circular cross-sectional shape adapted to be inserted in axial alignment within the clutch bearing 18 to engage rollers interior of said bearing, as described in more detail below. In this manner, the core 20 is free to rotate in one direction within the cartridge housing 12 but is constrained against rotation in an opposite direction, depending upon the orientation of the cartridge 10 within a supporting handle or the like, to be described below.

Figure 3:
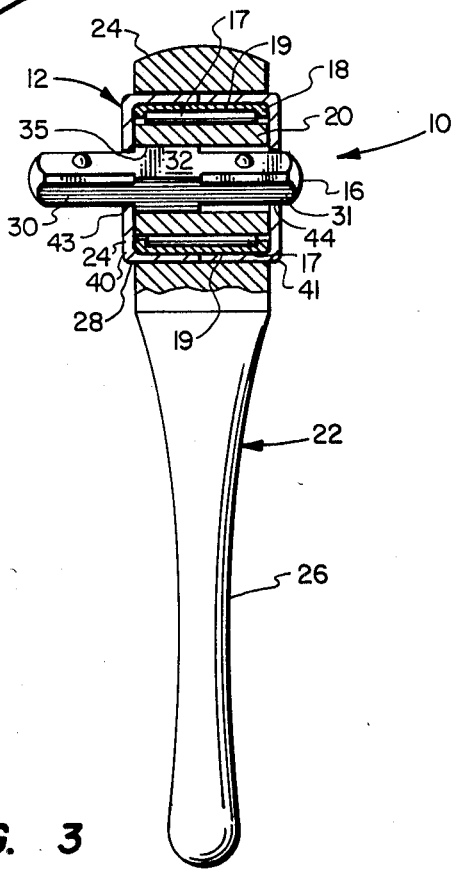
FIG. 3 is a side elevational, cross-sectional view of the tool cartridge of FIG. 1 taken along lines 3—3 thereof, and illustrating the interior portion of the drive mechanism and the relationship of the unidirectional clutch therein.

Referring now to FIG. 3, there is shown a side elevational, cross-sectional view of the cartridge 10 of FIG. 1 inserted within a typical wrench housing. A wrench 22 is thus shown having a head portion 24 and handle portion 26 extending therefrom. The tool cartridge 10 is preferably press-fitted within a generally cylindrical aperture 28 formed within the wrench head 24. In this configuration the cartridge housing 12 is firmly secured to the wrench 22 for purposes of rotational actuation. Such securement obviates conventional securing means such as staking or welding which can weaken the assembly structurally. Moreover, press-fitting permits repair and field replacement with conventional tools such as a standard arbor press, vise, or the like. Such repair is a distinct advantage with tool systems of this variety.

Still referring to FIG. 3, the bearing 18, core 20, and drive shaft 16 are shown in more detail. The drive shaft 16 includes front and back portions 30 and 31 interconnected by a central shouldered portion 32. The drive shaft 16 may also be seen to be dimensioned to extend a distance on either side of the housing 12. This enables the shaft portion 30, 31 to extend outwardly from the housing 12 depending upon the selective longitudinal position thereof. A central opening 35 is provided within the core 20 and is preferably configured to the same shape and size as the shouldered portion 32 of the drive shaft 16. In this manner, the drive shaft 25 is free to be slidingly and longitudinally moved and secured within the core 20. The walls defining the opening 35 engage the sides or edges of the drive shaft 16 to thereby transmit rotational motion of the bearing element 18 to the drive shaft 25 via the core 20. The drive shaft 16 is further confined within the housing 12 by the front and back faces 40 and 41 of the cups 15 and 14 respectively. The cup faces 40 and 41 each include a central opening 43 and 44 within which the front and back portions 30 and 31 of the drive shaft 16 are respectively located. The openings 43 and 44 are dimensioned such that the shouldered portion 32 of the drive shaft 16 abuts the walls of the respective front and back faces 40 and 41 upon longitudinal movement of the drive shaft 16 in the respective directions. In this manner, the cartridge 10 may be inserted in a wrench 22 for providing effective unidirectional drive.

It may further be seen that the high failure rate of conventional pneumatic tools due to the fragility of the ratchet pawl mechanism is substantially overcome with the present invention. The current pneumatic wrench configuration is an improvement over said prior art pneumatic assemblies in that the torsional drive is applied directly from the core 20 through the multitude of bearings 17 engaged adjacent wedge members 19 without backlash and similar assembly manifestations which tend to weaken the structure under heavy or impact loading conditions.

Figure 4:
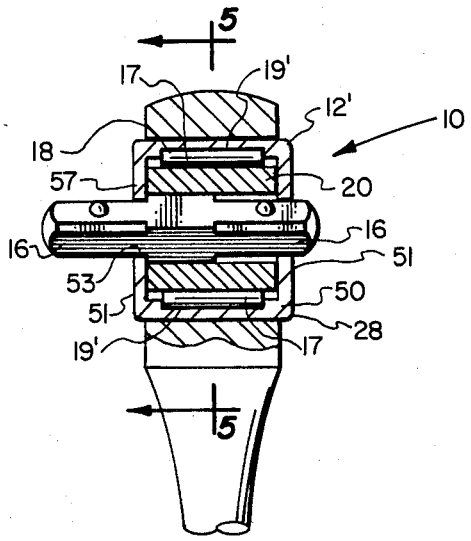
FIG. 4 is a side elevational, cross-sectional view of an alternative embodiment of the tool cartridge of FIG. 1 illustrating an alternative method of assembly thereof in accordance with the principles of the present invention.

Referring now to FIG. 4 there is shown an alternative embodiment of the assembly of the cartridge 10 in accordance with the principles of the present invention. Consistent with the teachings of the present invention, the cartridge 10 comprises the drive shaft 16 housed within a core 20 positioned within a series of roller bearing 17. The aforesaid assembly is also shown positioned within a housing 12' which differs from the housing 12 of FIGS. 1–3 in that it is of a unitary construction. The housing 12' comprises a generally cylindrical body portion 50 having a molded, or formed face 51 with an aperture 53 formed therein for receiving the drive shaft 16 therethrough. It may further be seen that the housing 12' includes integrally formed ramps or wedges 19' for engaging the roller bearings 17 mounted therein. The cartridge 10 thus exhibits increased structural integrity by the unitary construction and is formed with apertures through each end face for encapsulating the core 20 by flange region 57. The utilization of the unitary construction of housing 12' further facilitates field repair, wherein the flange 57 may be removed and/or reformed. Such field replacement and modification or repair of the cartridge 10 is a great advantage over conventional structures.

Referring now to FIGS. 1 and 4 in combination, the cartridge housing is constructed for utilization and high torque applications, on the order of 1800 in-lbs or greater. Such loading requires precision in the assembly of the cartridge into a wrench handle or similar device for transmitting the torque therethrough. For example the assembly as set forth in FIG. 3 necessitates a high tolerance press fit of the cartridge housing 12 into the wrench head 24. The housing 12/12' is thus centerless ground after manufacturing to control the concentricity, diameter, and taper thereof. The precision grinding is made possible by the provision of the housing 12 and affords securement of the one-way clutch cartridge 10 in high torque applications. Such loading and tolerance control is often impossible with certain prior art structures.

Figure 5:
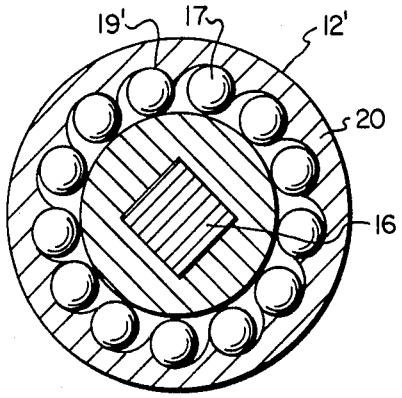
FIG. 5 is an end elevational, cross-sectional view of an alternative embodiment of the tool cartridge illustrated in FIG. 4.

Referring now to FIG. 5 there is shown an end elevational cross-sectional view of the housing 12' of FIG. 4. The ramps 19' are shown to be integrally formed within the side wall of the housing 12' and the rollers or bearings 17 disposed therein in a conventional configuration. The placement of the core 20 is likewise in accordance with that set forth above. The assembly of the cartridge 10 with the housing 12' affords the multiple advantages as set forth above as well as a unitary wall structure of increased strength and tolerance.

It should be noted that various other housing embodiments are considered within the scope of the present invention. For example, a cartridge housing having ends formed with "formed" flange regions on the opposite ends thereof may be utilized for the placement of the bearing assembly therein and incorporation of end plates 55 as described above. The utilization of the cartridge approach for the unidirectional drive assembly will itself afford numerous alternatives and applications for wrenches and related tools. In particular, the utilization of retaining members such as the bias ball elements 60 disposed upon opposite ends of the shaft 16 facilitates the securement of sockets (not shown) thereto in known fashions for conventional tool applications. With such socket fastening means, the cartridge 10 may be utilized with a myriad of wrench designs for conventional socket and unidirectional drive applications.

In operation, depending upon the direction of rotation of the drive shaft 16, the drive shaft 16 is moved in the direction of either the front or back 40 or 41 of the housing 12. In its selected longitudinal position, the torque which is applied to the housing 12 by the wrench 22 will be transmitted only in one direction to the drive shaft 16. Rotation in the opposite direction will result in the head 24 merely sliding along the bearing member 18 by virtue of the unidirectional action of the clutch. This will result in the torque not being transmitted to the drive shaft 16 as is normally desired. To apply torque in an opposite direction, the drive shaft 16 is longitudinally, slidably moved in the direction of the opposite face plate to extend in the opposite direction from the housing 12. In this configuration, it will be seen that a torque applied to the head 24 by the handle 26 in a direction opposite to that of the operation above described will be transmitted to the drive shaft 16 for the application of torque. Additionally, in like manner, the head 11 will merely slide upon the bearing member 18 when a rotational action in an opposite direction is applied.

As above mentioned, although the drive shaft member 16 is illustrated as being of the type to accommodate well known socket elements, other drive shaft functions can be suitably substituted. For instance, screwdriver blades (not shown) may be used in place of the front and back portions 30 and 31 of the drive shaft 16. Other such torque transmitting uses will be apparent to those skilled in the art. It will also be appreciated that the handle of 26 may be omitted in certain applications (not shown). For example, in handheld socket drive wrenches utilizing only the head portion with suitable finger indentations or the like can be easily fabricated as will be apparent to those skilled in the art. The utilization of a unidirectional drive tool cartridge may likewise be facilitated by making provisions for insertion of the cartridge into not only existing wrench structures but torque application members not normally suited for unidirectional drive.

Figure 6:
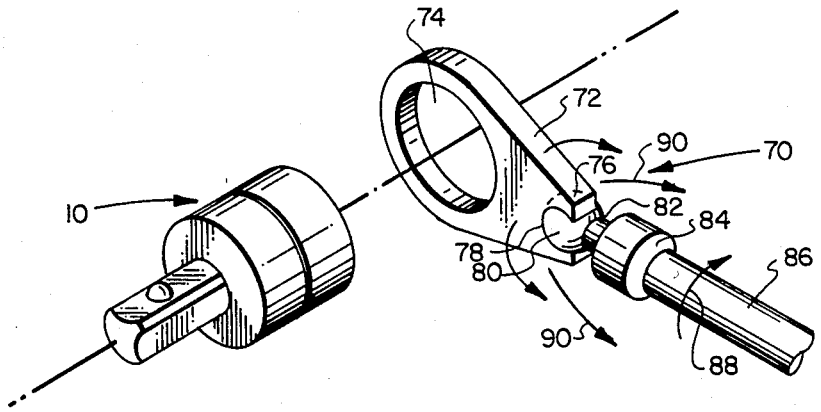
FIG. 6 is an exploded perspective view of the tool cartridge of FIG. 1 assembled to one embodiment of a pneumatic wrench linkage.

Referring now to FIG. 6 there is shown an exploded perspective view of the cartridge 10 assembled to the drive assembly of a pneumatic wrench of conventional design. The application of the cartridge 10 of the present invention within a pneumatic wrench 70 affords multiple advantages. The wrench 70 includes a yoke 72 having an aperture 74 formed therethrough. A neck portion 76 further includes an aperture 78 adapted for receiving a pivot ball 80 therein. The pivot ball 80 is adapted to mount upon a rotatable eccentric drive shaft 82 having an enlarged collar portion 84 disposed therebeneath. A drive shaft body portion 86 depends from collar 84 and is utilized to an actuation of the yoke 72. Rotation of the shaft 86 in the direction of arrow 88 then produces a reciprocating arcuate motion as reflected by arrow 90 adjacent aperture 78. The arcuate motion 90 transmitted through the yoke 72 imparts rotation to the cartridge 10 and the select one-way drive and advantages thereof set forth above. Moreover, the pneumatic wrench 70 may be utilized with or without actuation of the drive shaft 86 in similar manner to that illustrated in FIG. 3.

Figure 7:
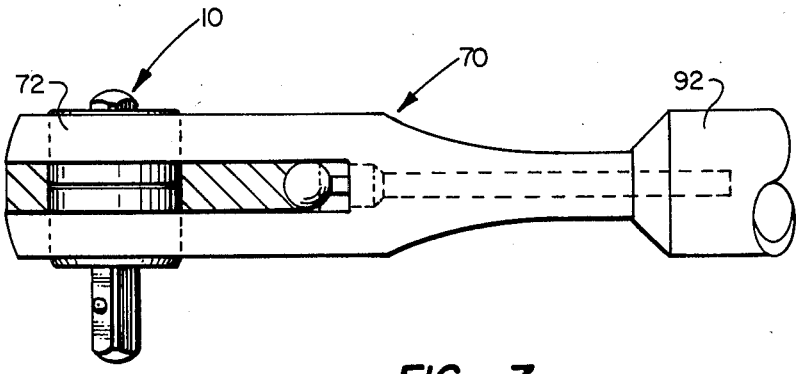
FIG. 7 is a side elevational, cross-sectional view of the tool cartridge/pneumatic wrench assembly of FIG. 6.

Referring now to FIG. 7 there is shown a side elevational, partially cross-sectional view of the wrench 70 of FIG. 6. The cartridge 10 is shown secured within yoke 72 with a handle portion 92 extending downwardly therefrom. Such wrench designs are conventional in the prior art and have utilized ratchet drives. Unfortunately, prior art ratchet mechanisms have specific pitch limitations due to the ratchet actuation not present in the present invention. Such pitch requirements limit the possible torque in such prior art assemblies, as well as causing spikes in the torque curve due to the pawl assembly. Such torque spikes result in repeated "shock" generation as the ratchet engages during each actuation.

In the present invention the degree of arcuate motion 90 necessary for unidirectional drive from the cartridge 10 is virtually infinitesimal relative to such prior art ratchet mechanisms. Moreover, there is virtually no "backlash" which produces the prior art torque spikes. This permits an increase in overall torque for each actuation as well as an increase in efficiency on the order of 30%. The speed of actuation will also increase on the order of 30% which reduces the air consumption and conserves energy. This is a distinct advantage in the utilization of pneumatic or hydraulic drive assemblies. Moreover, such pneumatic wrenches can be constructed with thinner yokes 72 due to the unitary assembly of the cartridge 10. It may likewise be seen that the advantages of repair replacement and reliability as well as effective actuation are manifested in the assembly of yoke 70 which would not be present in other prior art embodiments.

Figure 8:
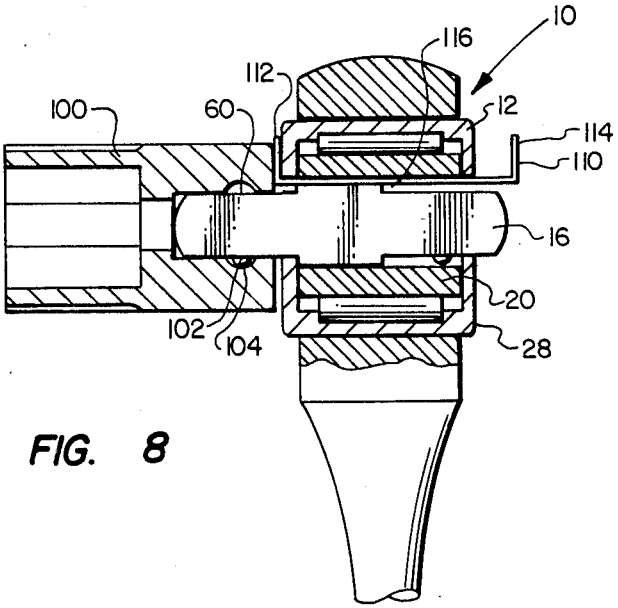
FIG. 8 is a side elevational, cross-sectional view of an alternative embodiment of the tool cartridge of FIG. 1 with a socket element mounted thereto.

Referring now to FIG. 8, there is shown a tool cartridge 10 constructed in accordance with the principles of the present invention having mounted thereto a conventional socket member 100. Socket member 100 is coupled to drive shaft 16 by detent means 102 comprising a groove 104 within the socket 100 matingly receiving bias ball element 60 therein. For removing the socket 100 the cartridge 10 includes a slidable tang 110 having upstanding end faces 112 and 114 on opposite ends of a central shank region 116. The shank region 116 is disposed within the housing 12 atop the shaft 16 and beneath the core 20. Positioning of the socket 100 upon the first end of the cartridge 10 produces a movement of the tang 110 through the housing 12 for extension from the other side thereof. Likewise, removal of the socket 10 is implemented by application of a simple pressure to the end 114 of the tang 110 wherein it is imparted to move in a reverse direction wherein end 112 engages the socket 100 to uncouple same from shaft 16. In this manner the cartridge 10 of the present invention can be utilized for a multitude of socket and related tool applications in a manner facilitating rapidity in assembly and disassembly.

Figure 9:
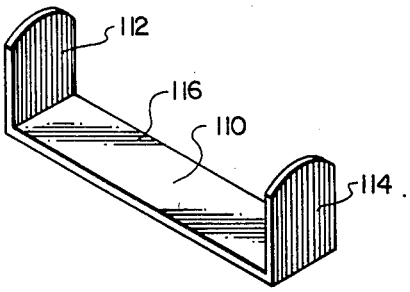
FIG. 9 is an enlarged perspective view of the sliding flange depicted in FIG. 8 for demounting the tool socket thereon.

Referring now to FIG. 9 there is shown a perspective view of the slidable tang 110 wherein the end portions 114 and 112 are shown to upstand in generally orthogonal relationship to central body portion 116. The end portions 114 are likewise constructed for providing sufficient surface area to permit the finger area of a user to apply sufficient pressure for removal of a typical socket 100 therefrom. Obviously the specific embodiment of the tank 110 and/or configurations of the end regions 112 and 114 thereof may be varied in accordance with particular applications of the cartridge 10 and/or tool removal needs thereof.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims:

What is claimed is:

1. A unidirectional drive cartridge adapted for securement to a force application member for directional torque transmission, comprising:

a housing including first and second thin walled cup members adapted for matingly engaging one another;

a unidirectional clutch mounted within said two-cup housing, said clutch having a central opening extending therethrough;

a torque transmitting drive shaft disposed within said clutch and having front and back portions for extending outwardly of said clutch and a central shoulder portion for containment therein;

means for slidably receiving said drive shaft within said central opening of said clutch to enable selective, slidable, longitudinal positioning of said drive shaft within said receiving means and rotational engagement of said drive shaft by said receiving means;

said drive shaft receiving means being located within said clutch to freely rotate in a first direction and to be constrained by said clutch against rotation in a second opposite direction;

said housing further including front and back faces, each having a central aperture within which said front and back drive shaft portions are located and of a size to engage said shoulder portion of said drive shaft against said faces to constrain it within said receiving means;

said drive shaft being longitudinally located within said housing wherein a torque applied to said housing will be transmitted only in one direction by said drive shaft, and when said drive shaft is longitudinally located in the direction of an opposite face, a torque applied to said housing being transmitted only in an opposite direction;

said drive shaft being of a generally square cross-sectional configuration;

said drive shaft being adapted to receive a socket mounted thereon in secured engagement therewith for the transmission of torque therethrough; and said drive shaft further including socket retainer elements on said front and back portions thereof.

2. The apparatus as set forth in claim 1 wherein said clutch comprises a Torrington type clutch for providing unidirectional torque application.

3. The apparatus set forth in claim 1 and further including a tang having upstanding end faces on opposite ends of a central shank region, said shank region being disposed within said housing upon said shaft in slidable enagement therewith for selective positioning and engagement with a socket mounted upon said shaft for facilitating the removal thereof.

* * * * *